US011769614B2

(12) United States Patent
Ishida et al.

(10) Patent No.: US 11,769,614 B2
(45) Date of Patent: Sep. 26, 2023

(54) COIL COMPONENT AND METHOD FOR PRODUCING MAGNETIC POWDER-CONTAINING RESIN MATERIAL USED THEREFOR

(71) Applicant: Murata Manufacturing Co., Ltd., Kyoto-fu (JP)

(72) Inventors: Keiichi Ishida, Nagaokakyo (JP); Koichi Ida, Nagaokakyo (JP); Hideaki Ooi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 326 days.

(21) Appl. No.: 17/036,776

(22) Filed: Sep. 29, 2020

(65) Prior Publication Data

US 2021/0098163 A1 Apr. 1, 2021

(30) Foreign Application Priority Data

Sep. 30, 2019 (JP) ..... 2019-178248

(51) Int. Cl.

| | |
|---|---|
| ***H01F 1/24*** | (2006.01) |
| ***H01F 41/02*** | (2006.01) |
| ***H01F 27/255*** | (2006.01) |
| ***H01F 1/26*** | (2006.01) |
| ***H01F 17/04*** | (2006.01) |

(52) U.S. Cl.

CPC ..... *H01F 1/24* (2013.01); *H01F 1/26* (2013.01); *H01F 17/04* (2013.01); *H01F 27/255* (2013.01); *H01F 41/0246* (2013.01); *H01F 2017/048* (2013.01)

(58) Field of Classification Search

None

See application file for complete search history.

(56) References Cited

U.S. PATENT DOCUMENTS 10,431,365 B2 * 10/2019 Kubota ..... H01F 17/0013
10,875,095 B2 * 12/2020 Inoue ..... H01F 17/0013
(Continued)

FOREIGN PATENT DOCUMENTS

CN 1321991 A 11/2001
CN 108735432 A 11/2018
(Continued)

*Primary Examiner* — Kevin M Bernatz

(74) *Attorney, Agent, or Firm* — Studebaker & Brackett PC

(57) ABSTRACT

A coil component that can maintain a high magnetic permeability and improve a DC superposition characteristic, and a method for producing a magnetic powder-containing resin material used to provide such a coil component. A coil component according includes an element body including a coil conductor and a magnetic portion. The coil conductor is formed of a wound conductor wire. The magnetic portion containing metal magnetic material grains covered with an insulating coating, a resin, and insulator grains. The coil component further includes an external electrode electrically connected to an extended portion of the coil conductor and disposed on a surface of the element body. The insulator grains have a relative permeability lower than a relative permeability of the metal magnetic material grains, and the insulator grains and the insulating coating are a compound whose main component is the same.

20 Claims, 5 Drawing Sheets

Detail view of part a

(56) References Cited

U.S. PATENT DOCUMENTS

| | | | | |
|---|---|---|---|---|
| 11,657,952 | B2 * | 5/2023 | Araki | H01F 27/327 336/192 |
| 2002/0097124 | A1 | 7/2002 | Inoue et al. | |
| 2008/0231409 | A1 * | 9/2008 | Kugai | H01F 41/0246 336/219 |
| 2012/0038532 | A1 * | 2/2012 | Yonetsu | H01Q 17/00 427/127 |
| 2013/0056674 | A1 * | 3/2013 | Inagaki | H01F 3/08 977/773 |
| 2013/0228716 | A1 * | 9/2013 | Suetsuna | H01F 1/15333 427/127 |
| 2016/0071636 | A1 * | 3/2016 | Ohtsubo | H01F 1/26 148/307 |
| 2018/0308613 | A1 | 10/2018 | Ishida et al. | |
| 2019/0180909 | A1 * | 6/2019 | Shinohara | H01F 27/292 |
| 2019/0267170 | A1 * | 8/2019 | Nakamura | B22F 1/16 |
| 2019/0333666 | A1 * | 10/2019 | Nakamura | H01F 1/24 |
| 2020/0035391 | A1 * | 1/2020 | Suetsuna | H01F 1/0551 |
| 2021/0280347 | A1 * | 9/2021 | Nakamura | H01F 1/24 |

FOREIGN PATENT DOCUMENTS

| | | | |
|---|---|---|---|
| JP | 2014127624 | A | 7/2014 |
| JP | 2015079931 | A | 4/2015 |
| JP | 2017103287 | A | 6/2017 |
| WO | 2011118774 | A1 | 9/2011 |

* cited by examiner

Detail view of part a

COIL COMPONENT AND METHOD FOR PRODUCING MAGNETIC POWDER-CONTAINING RESIN MATERIAL USED THEREFOR

CROSS-REFERENCE TO RELATED APPLICATION

This application claims benefit of priority to Japanese Patent Application No. 2019-178248, filed Sep. 30, 2019, the entire content of which is incorporated herein by reference.

BACKGROUND

Technical Field

The present disclosure relates to a coil component and a method for producing a magnetic powder-containing resin material used for the coil component.

Background Art

A magnetic member is used in conventional coil components and the like. Such coil components are required to be miniaturized, and it is further required that the magnetic member has a high magnetic permeability and a high saturation magnetic flux density. Therefore, a magnetic sheet used for producing the coil component including such a magnetic member having a high magnetic permeability and a high saturation magnetic flux density is disclosed (see, for example, Japanese Patent Application Laid-open No. 2014-127624).

The magnetic sheet as disclosed in Japanese Patent Application Laid-open No. 2014-127624 is composed of a magnetic sheet having a magnetic filler containing a binder resin, and the filling rate of the magnetic filler is at least 90% by weight in order to achieve a high magnetic permeability and a high saturation magnetic flux density. Further, the magnetic filler contains a magnetic filler having grains of at least one kind of metal selected from an amorphous metal and an insulating surface-treated crystalline metal, and the magnetic sheet has a surface resistance value of 106 Ω/sq or more. That is, the magnetic sheet disclosed in Japanese Patent Application Laid-open No. 2014-127624 is highly filled with the magnetic filler.

SUMMARY

However, as described above, since the magnetic sheet disclosed in Japanese Patent Application Laid-open No. 2014-127624 is highly filled with metal magnetic material grains in order to improve the magnetic permeability, there is a problem that the DC superposition characteristic, which is one of the characteristics of the coil component, deteriorates when the coil component is produced by using such a magnetic sheet.

Therefore, the present disclosure provides a coil component that can maintain a high magnetic permeability and improve the DC superposition characteristic.

The present disclosure also provides a method for producing a magnetic powder-containing resin material for obtaining the coil component that can maintain a high magnetic permeability and improve the DC superposition characteristic.

The coil component according to the present disclosure includes an element body including a coil conductor and a magnetic portion. The coil conductor is formed of a wound conductor wire, and the magnetic portion contains metal magnetic material grains covered with an insulating coating, a resin, and insulator grains. The coil component further includes an external electrode electrically connected to an extended portion of the coil conductor and disposed on a surface of the element body. The insulator grains have a relative permeability lower than a relative permeability of the metal magnetic material grains. The insulator grains and the insulating coating are a compound whose main component is the same.

In addition, a method for producing a magnetic powder-containing resin material according to the present disclosure is a method including mixing metal magnetic material grains and an insulating material; forming an insulating coating on a surface of the metal magnetic material grains using a part of the insulating material by a mechanochemical treatment; and mixing the metal magnetic material grains covered with the insulating coating, a remaining part of the insulating material, and a resin material. The insulating material has a relative permeability that is lower than a relative permeability of the metal magnetic material grains.

In the coil component according to the present disclosure, since the insulator grains having magnetism lower than the magnetism of the metal magnetic material grains are dispersed and disposed in the entire magnetic portion, a magnetic flux flow is cut off by the insulator grains dispersed in the magnetic portion and the insulating coating of the metal magnetic material grains, and the DC superposition characteristic can be improved. Further, since the magnetic flux flow is not completely cut off, a decrease of the inductance value can be suppressed.

In addition, since materials of the insulator grains and the insulating coating are an identical component, there is no need to remove the insulator grains that are required to be removed in the production process, and the magnetic powder-containing resin material that can be used to provide the above-mentioned coil component can be produced.

According to the present disclosure, it is possible to provide a coil component that can maintain a high magnetic permeability and improve a DC superposition characteristic.

Moreover, according to the present disclosure, it is possible to provide a method for producing a magnetic powder-containing resin material for obtaining the coil component that can maintain a high magnetic permeability and improve the DC superposition characteristic.

The above-mentioned objects, other objects, features, and advantages of the present disclosure will become more apparent from the following detailed description of the disclosure with reference to the drawings.

BRIEF DESCRIPTION OF THE DRAWINGS

FIG. 5B is a partially enlarged view of part a.

DETAILED DESCRIPTION

1. Coil Component

Hereinafter, the coil component of the present disclosure is described in detail with reference to the drawings.

Figure 1:
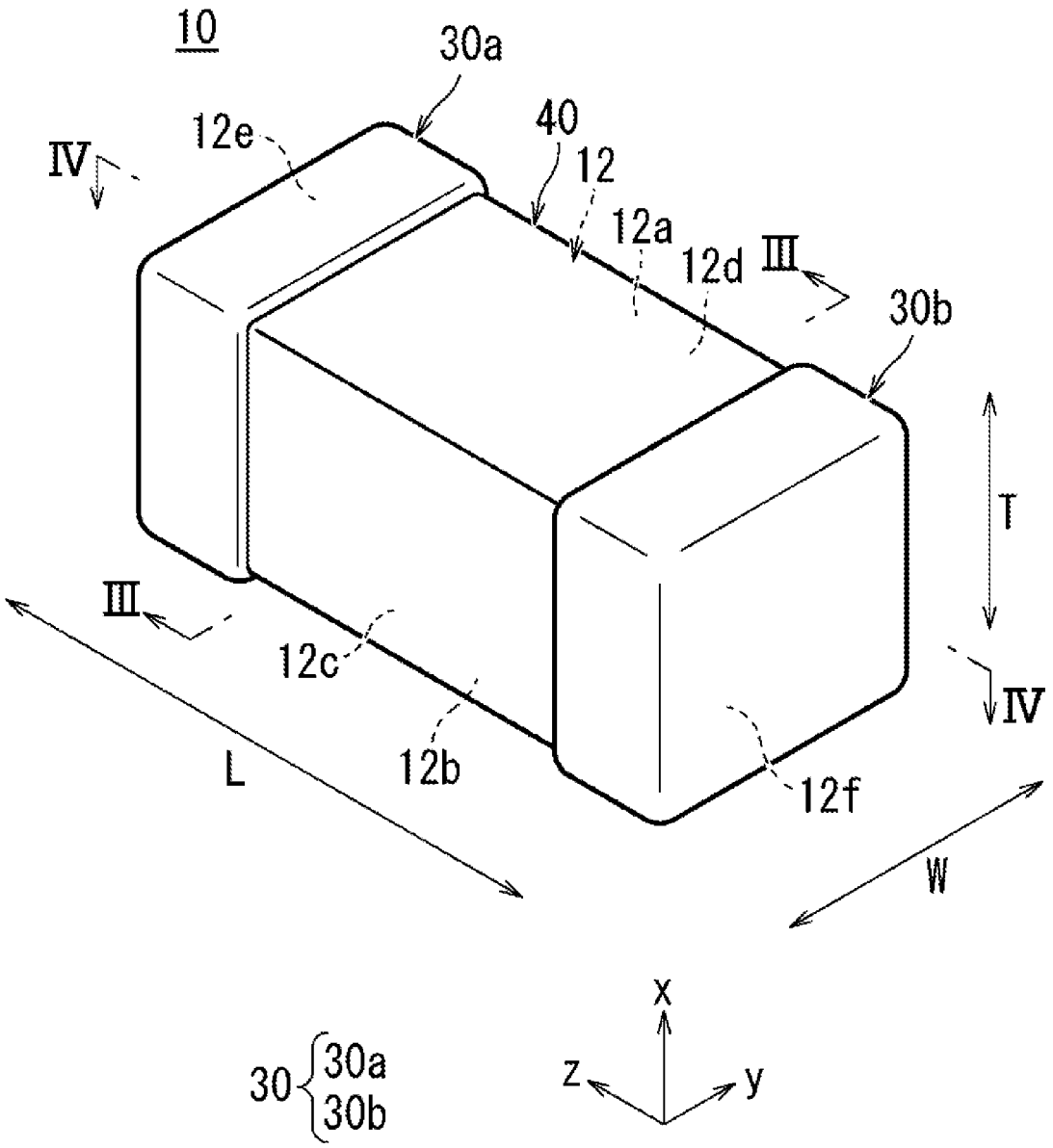
FIG. 1 is an external perspective view schematically showing an embodiment of a coil component of the present disclosure.
Figure 2:
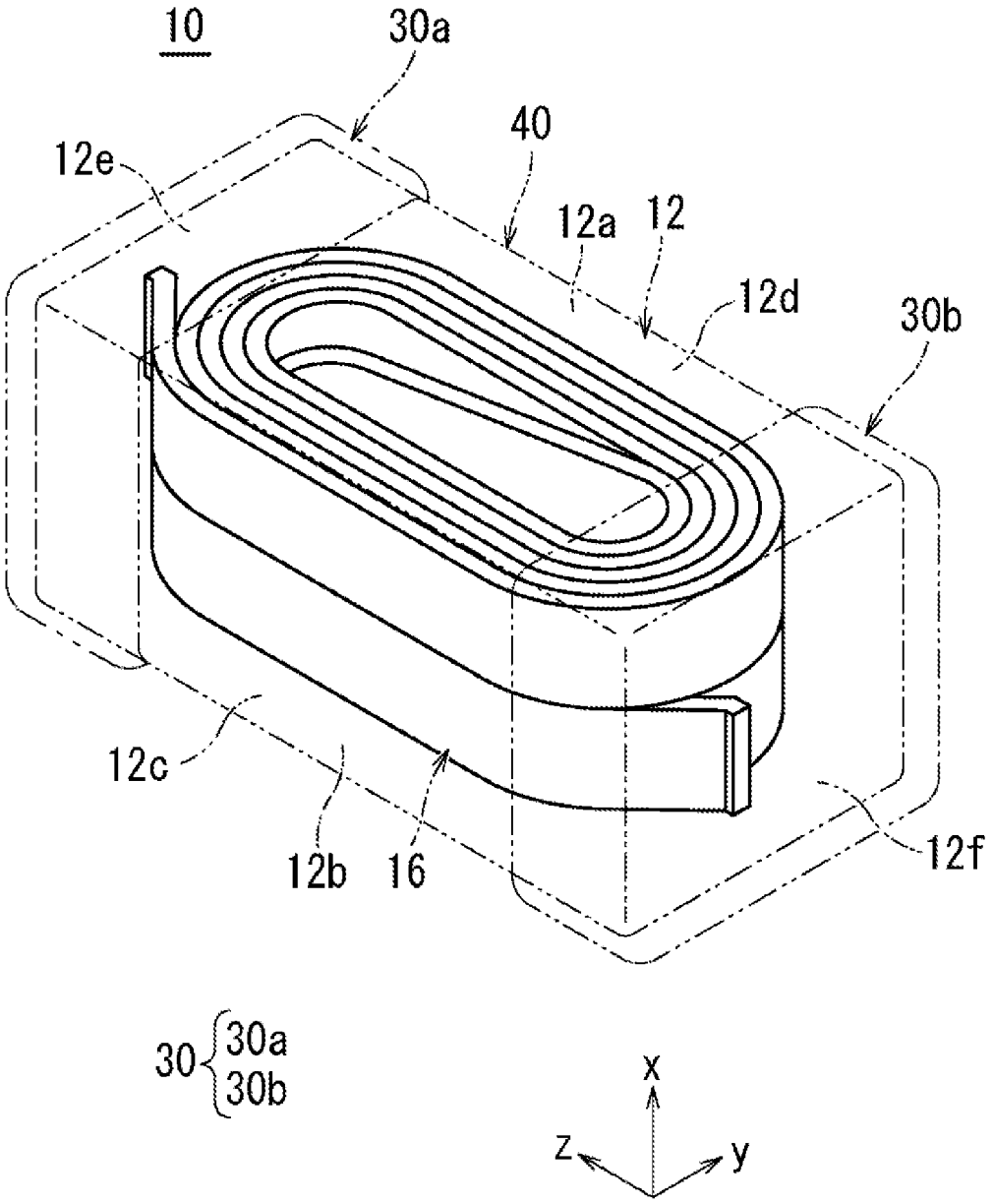
FIG. 2 is a transparent perspective view of a magnetic portion in which a coil conductor is embedded in the coil component shown in FIG. 1.
Figure 3:
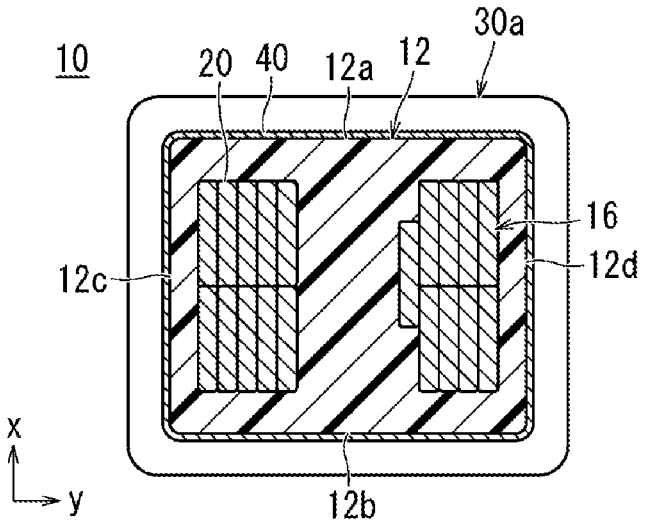
FIG. 3 is a sectional view along a line in FIG. 1 and showing the coil component according to the present disclosure.
Figure 4:
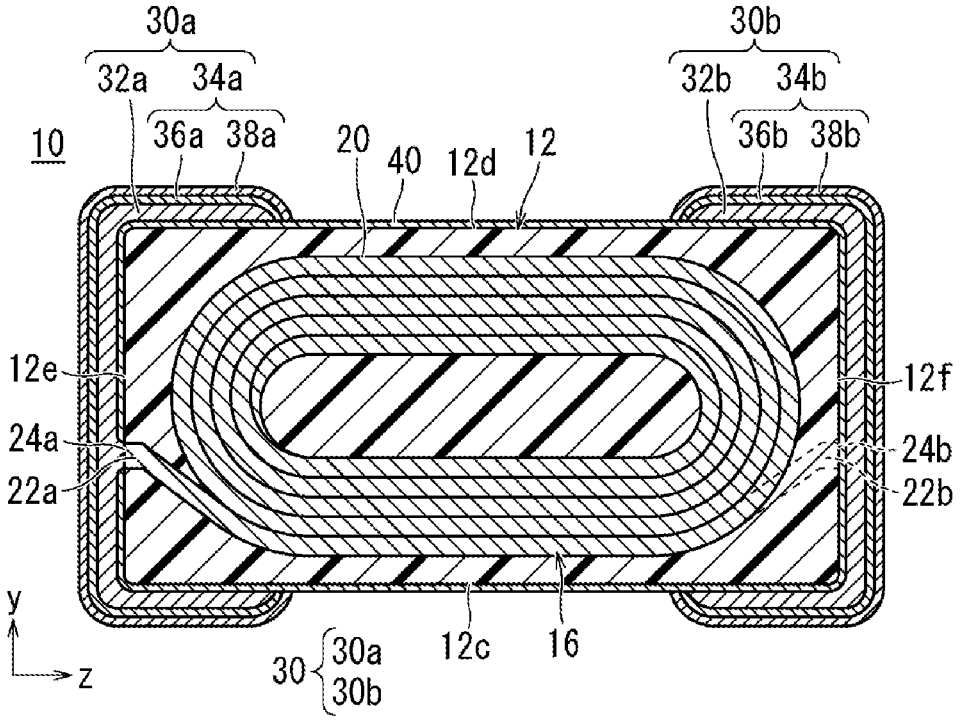
FIG. 4 is a sectional view along a line IV-IV in FIG. 1 and showing the coil component according to the present disclosure.
Figure 5A:
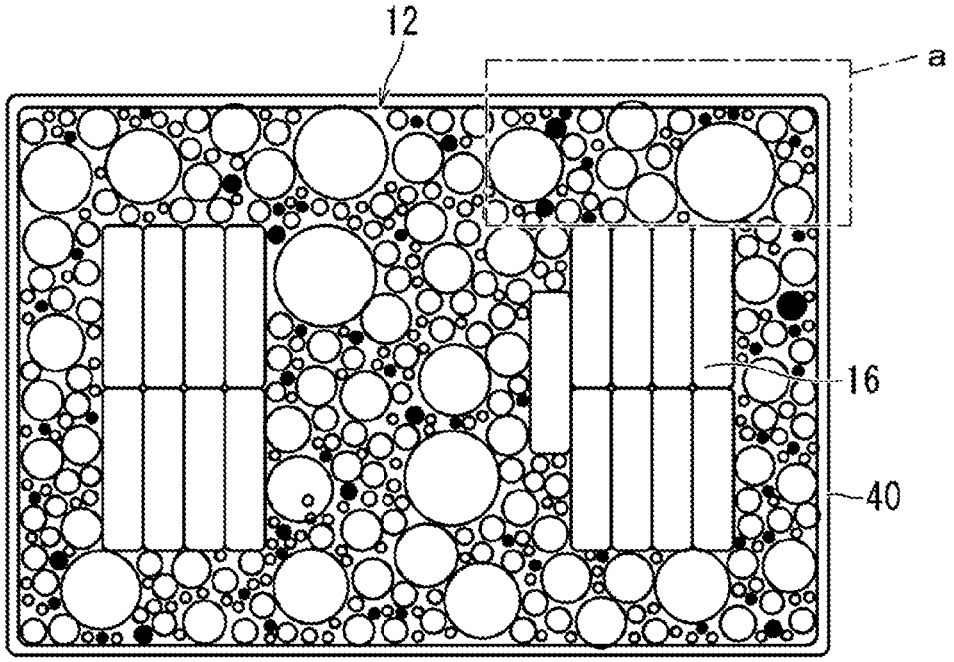
FIG. 5A is a sectional schematic view of an element body of the coil component according to the present disclosure.
Figure 5B:
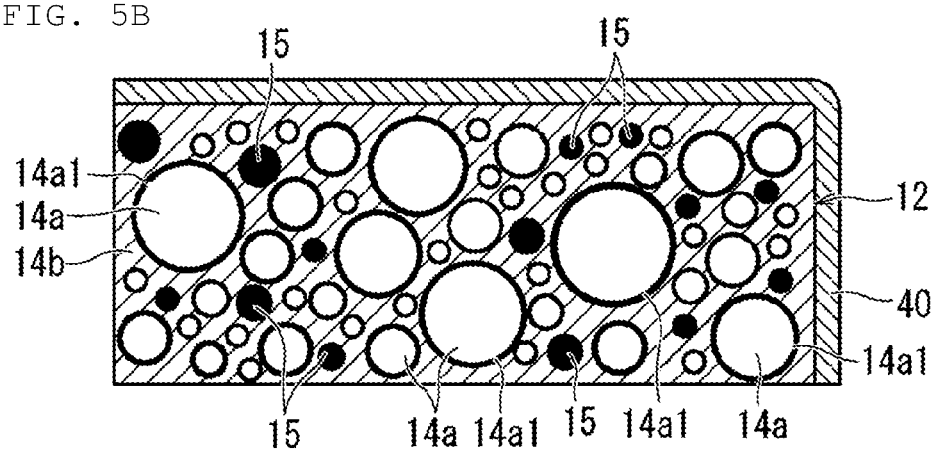

FIG. 1 is an external perspective view schematically showing an embodiment of a coil component of the present disclosure. FIG. 2 is a transparent perspective view of a magnetic portion in which a coil conductor is embedded in the coil component shown in FIG. 1. FIG. 3 is a sectional view along a line in FIG. 1 and showing the coil component according to the present disclosure. FIG. 4 is a sectional view along a line IV-IV in FIG. 1 and showing the coil component according to the present disclosure. FIG. 5A is a sectional schematic view of an element body of the coil component according to the present disclosure, and FIG. 5B is a partially enlarged view of part a in FIG. 5A.

A coil component 10 has a rectangular parallelepiped element body 12 and an external electrode 30.

(A) Element Body

The element body 12 has a magnetic portion 14 and a coil conductor 16 embedded in the magnetic portion 14. The element body 12 has a first main surface 12*a* and a second main surface 12*b* facing in a pressing direction x, a first side surface 12*c* and a second side surface 12*d* facing in a width direction y orthogonal to the pressing direction x, and a first end surface 12*e* and a second end surface 12*f* facing in a length direction z orthogonal to the pressing direction x and the width direction y. The size of the element body 12 is not particularly limited.

(B) Magnetic Portion

The magnetic portion 14 contains metal magnetic material grains 14*a*, a resin material 14*b*, and insulator grains 15 as shown in FIG. 5B.

The resin material is not particularly limited, and examples of the resin material include organic materials such as an epoxy resin, a phenol resin, a polyester resin, a polyimide resin, and a polyolefin resin. Only one kind of the resin material or two or more kinds of the resin materials may be used.

The metal magnetic material grains 14*a* contain first metal magnetic material grains. The metal magnetic material grains may further contain second metal magnetic material grains.

The first metal magnetic material grains may have an average grain diameter of 10 μm or more. Further, the first metal magnetic material grains preferably have an average grain diameter of 200 μm or less, more preferably 100 μm or less, and further preferably 80 μm or less. When the average grain diameter of the first metal magnetic material grains is controlled to be 10 μm or more, the filling rate of the metal magnetic material grains can be increased and the effective magnetic permeability of the magnetic portion is improved.

The second metal magnetic material grains have an average grain diameter smaller than the average grain diameter of the first metal magnetic material grains. The second metal magnetic material grains have an average grain diameter of 10 μm or less. Thus, the average grain diameter of the second metal magnetic material grains is smaller than the average grain diameter of the first metal magnetic material grains, so that a filling property of the metal magnetic material grains in the magnetic portion 14 is further improved. Therefore, magnetic characteristics of the coil component 10 can be improved.

Here, the average grain diameter means the average grain diameter D50 (a grain diameter corresponding to a cumulative percentage of 50% on a volume basis). The average grain diameter D50 can be measured, for example, by a grain size analyzer using dynamic light scattering (UPA manufactured by NIKKISO CO., LTD.).

The first metal magnetic material grains and the second metal magnetic material grains are not particularly limited, and examples of the first metal magnetic material grains and the second metal magnetic material grains include iron, cobalt, nickel and gadolinium, and alloys containing one kind or more than one kind of these metals. Preferably, the first metal magnetic material grains are iron or an iron alloy. The iron alloy is not particularly limited, and examples of the iron alloy include Fe—Si, Fe—Si—Cr, and Fe—Si—Al. Only one kind or two or more kinds may be used as for the first metal magnetic material grains and the second metal magnetic material grains.

The surfaces of the first metal magnetic material grains and the second metal magnetic material grains are covered with an insulating coating 14*a*1 as shown in FIG. 5B. The surface of the metal magnetic material grains is covered with the insulating coating 14*a*1, so that the specific resistance inside the magnetic portion 14 can be increased.

A material of the insulating coating 14*a*1 has a relative permeability lower than a relative permeability of the metal magnetic material grains 14*a*. More preferably, the material of the insulating coating 14*a*1 is non-magnetic. Specifically, the material of the insulating coating 14*a*1 includes phosphate glass. In particular, an insulating coating formed of zinc phosphate glass that is subjected to a mechanochemical treatment is preferable. The glass component contains at least one element selected from the group consisting of Si, P, Bi, B, Ba, V, Sn, Te, K, Ca, Zn, Na and Li.

The thickness of the insulating coating 14*a*1 can be preferably 5 nm or more and 500 nm or less (i.e., from 5 nm to 500 nm), more preferably 10 nm or more and 250 nm or less (i.e., from 10 nm to 250 nm), but is not particularly limited. The average thickness of the insulating coating 14*a*1 is preferably 30 nm or more. The thickness of the insulating coating 14*a*1 can be increased to raise the specific resistance of the magnetic portion 14 When the metal magnetic material grains are highly filled by increasing the thickness of the insulating coating, a short-circuit between the metal magnetic material grains or between the metal magnetic material grains and the coil conductor can be prevented, and an improvement of the dielectric strength voltage can be expected. On the other hand, the amount of the metal magnetic material grains in the magnetic portion 14 can be increase by reducing the thickness of the insulating coating 14*a*1, and thus the magnetic characteristics of the magnetic portion 14 can be improved.

The thickness of the insulating coating 14*a*1 of the metal magnetic material grains is observed and measured with a transmission electron microscope (TEM) after a focused ion beam (FIB) treatment. Since there are variations in the thickness, for example, 15 sites (5 grains, 3 sites per grain) or more are observed, and the average of the thicknesses is calculated to obtain the average thickness. The observation magnification is preferably about 50000 times or more and 500000 times or less (i.e., from about 50000 times to 500000 times).

The rate of the content of the first metal magnetic material grains and the second metal magnetic material grains in the magnetic portion 14 in the entire magnetic portion is preferably 50 vol % or more, more preferably 60 vol % more, and further preferably 70 vol % or more. The content of the first metal magnetic material grains and the second metal magnetic material grains is controlled within the above-mentioned range to improve the magnetic characteristics of the coil component of the present disclosure. The rate of the content of the first metal magnetic material grains and the second metal magnetic material grains in the entire magnetic portion 14 is preferably 99 vol % or less, more preferably 95 vol % or less, and further preferably 90 vol % or less. The content of the first metal magnetic material grains and the second metal magnetic material grains is controlled within the above-mentioned range, so that the specific resistance of the magnetic portion 14 can be further increased.

A region adjacent to the coil conductor 16 may be removed in a surface portion of the magnetic portion 14. When the region of the magnetic portion 14 adjacent to the coil conductor 16 is removed, a gap between the magnetic portion 14 and the coil conductor 16 is increased to increase an exposed area of the coil conductor 16. As a result, a connection area of the coil conductor 16 with the external electrode 30 is increased, and it is expected that the joint strength is improved and the DC resistance is reduced.

The insulator grains 15 have a relative permeability lower than the relative permeability of the metal magnetic material grains 14*a*. More preferably, the insulator grains 15 are non-magnetic. Further, the insulator grains 15 preferably contain a glass component. The glass component contains at least one element selected from the group consisting of Si, P, Bi, B, Ba, V, Sn, Te, K, Ca, Zn, Na and Li.

Further, the insulator grains 15 and the insulating coating 14*a*1 that covers the metal magnetic material grains 14*a* are a compound whose main component is the same.

The insulator grains 15 contained in the magnetic portion 14 are identified as follows. That is, a cross section of the magnetic portion 14 is exposed by ion milling, polishing, or the like, and then the components of the insulating coating 14*a*1 of the metal magnetic material grains 14*a* contained in the magnetic portion 14 and the insulator grains 15 can be identified by performing elemental analysis using energy dispersive X-ray spectroscopy (EDX). Regarding the determination as to whether the components are the same, when the result of the elemental analysis shows a deviation from the stoichiometric ratio, the components are regarded as the same compounds.

In particular, when the glass component is zinc phosphate glass, too high a content of the insulator grains 15 decreases the inductance (hereinafter, referred to as poor moisture resistance) due to a moisture resistance shelf test. Therefore, as for the content of the insulator grains, the rate of the area of the insulator grains in the area of the cross section of the magnetic portion is preferably 0.1% or more and 5.0% or less (i.e., from 0.1% to 5.0%), more preferably 0.1% or more and 4.0% or less (i.e., from 0.1% to 4.0%). Further preferably, as for the content of the insulator grains, the rate of the area of the insulator grains in the area of the cross section of the magnetic portion is 1.0% or more and 2.0% or less (i.e., from 1.0% to 2.0%).

In addition, as for the content of the insulator grains, the rate of the area of the insulator grains in the area of the metal magnetic material grains in the cross section of the magnetic portion is preferably 0.1% or more and 6.0% or less (i.e., from 0.1% to 6.0%), more preferably 0.1% or more and 4.8% or less (i.e., from 0.1% to 4.8%). The rate is further preferably 1.2% or more and 2.4% or less (i.e., from 1.2% to 2.4%).

As a result, the DC superposition characteristic of the coil component 10 can be significantly improved.

The above-mentioned rate of the area (area rate) of each of the insulator grains is calculated as follows.

That is, first, a cross section of the coil component 10 is exposed using a sectional milling device, and the cross section is observed using a scanning electron microscope (SEM). Since the insulator grains are observed so as to be distinguished from the metal magnetic material grains, the external electrode, the coil conductor, and the resin material by a contrast, the insulator grains are easily identified. In the cross section to be observed, the content rate of the insulator grains is calculated as the area rate. The observation magnification is preferably about 500 to 2000 times.

In the present embodiment, the rate of the area of the insulator grains is almost equal to the rate of the volume of the insulator grains.

Further, the insulator grains 15 and the insulating coating 14*a*1 that covers the metal magnetic material grains 14*a* contain the identical component as a main component. Then, it is not necessary to remove a residue of the insulator grains 15 generated by the coating treatment of the metal magnetic material grains 14*a*, and the insulator grains 15 can be mixed into the magnetic portion 14 as they are, and as a result, the insulator grains 15 can be added to the magnetic portion 14.

Inside the magnetic portion 14, a non-magnetic layer may be inserted and disposed so as to sandwich the coil conductor 16. Thus, the DC superposition characteristic of the coil component 10 can be improved. The non-magnetic layer preferably contains a component identical to a component contained in the magnetic portion 14. As a result, peeling between the non-magnetic layer and other layers inside the magnetic portion 14 is unlikely to occur.

(C) Coil Conductor

The coil conductor 16 includes a winding portion 20 formed of a coiled conductive wire containing a conductive material, a first extended portion 22*a* extended to one side of the winding portion 20, and a second extended portion 22*b* extended to the other side of the winding portion 20.

The winding portion 20 is formed of a coiled conductive wire and formed into two tiers. The coil conductor 16 is formed of a flat type conductor wire that is coiled in an α-winding shape. As for the flat type conductor wire, the dimension in the width direction y is preferably 15 μm or more and 200 μm or less (i.e., from 15 μm to 200 μm), and the dimension in the pressing direction x is 50 μm or more and 500 μm or less (i.e., from 50 μm to 500 μm).

The first extended portion 22*a* is exposed from a first end surface 12*e* of the element body 12 and has a first exposed portion 24*a*, and the second extended portion 22*b* is exposed from a second end surface 12*f* of the element body 12 and has a second exposed portion 24*b*.

Here, a modified example of the element body 12 of the coil component 10 according to the embodiment of the present disclosure is described.

Figure 6A:
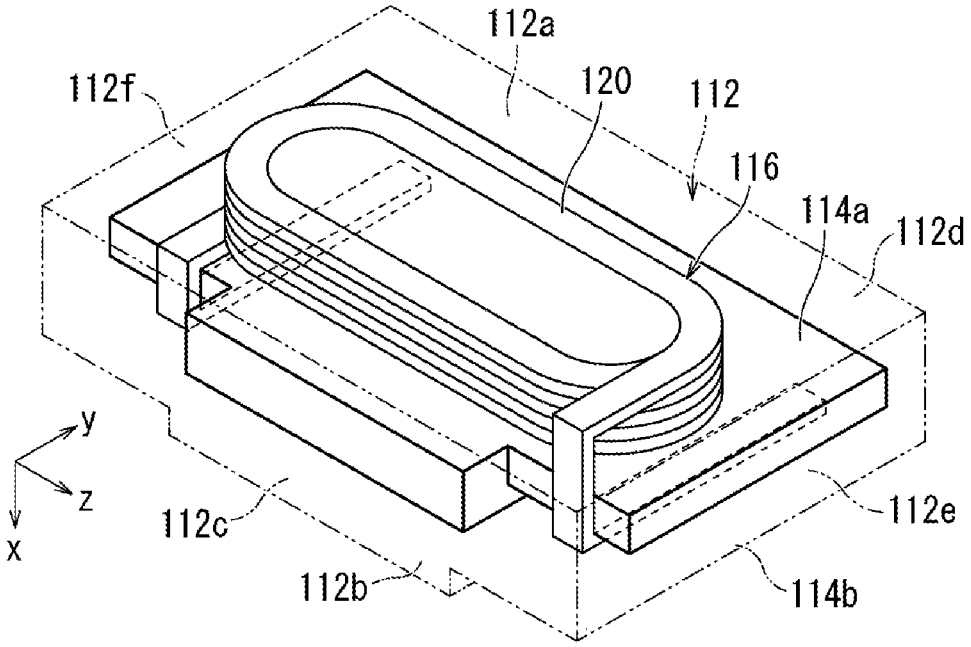
FIG. 6A is a transparent perspective view showing a modified example of the element body of the coil component according to the embodiment of the present disclosure.
Figure 6B:
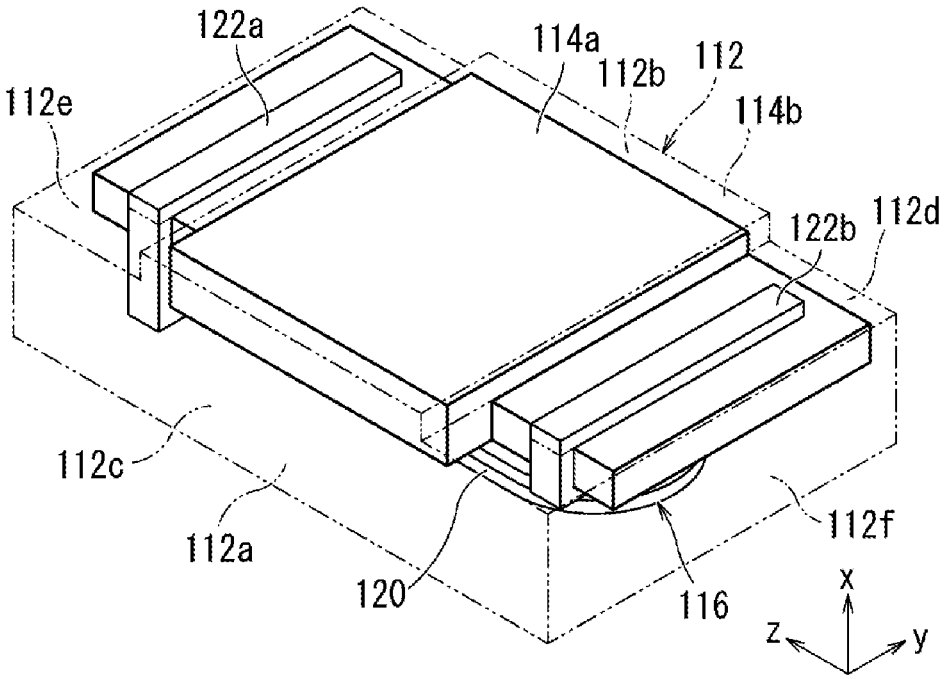
FIG. 6B is a transparent perspective view seen from a direction different from a direction of FIG. 6A.

FIG. 6A is a transparent perspective view showing the modified example of the element body of the coil component according to the embodiment of the present disclosure, and FIG. 6B is a transparent perspective view seen from a direction different from a direction of FIG. 6A.

An element body 112 has a magnetic portion 114 and a coil conductor 116 embedded in the magnetic portion 114 as shown in FIGS. 6A and 6B. The element body 112 is formed in a substantially rectangular parallelepiped shape and has a first main surface 112*a* and a second main surface 112*b* facing in the height direction x, a first side surface 112*c* and a second side surface 112*d* facing in the width direction y orthogonal to the height direction x, and a first end surface 112*e* and a second end surface 112*f* facing in the length direction z orthogonal to the height direction x and the width direction y.

The magnetic portion 114 has a first magnetic portion 114*a* disposed inside the element body 112, and a second magnetic portion 114*b* that covers the first magnetic portion 114*a* and the coil conductor 116.

The coil conductor 116 is disposed on one surface side of the first magnetic portion 114*a*, and includes a winding portion 120 formed of a coiled conductive wire containing a conductive material, a first extended portion 122*a* extended to one side of the winding portion 120, and a second extended portion 122*b* extended to the other side of the winding portion 120. The first extended portion 122*a* is extended and exposed to a side of the first end surface 112*e* of the second main surface 112*b* of the element body 112, and the second extended portion 122*b* is extended and exposed to a side of the second end surface 112*f* of the second main surface 112*b* of the element body 112.

In this way, the first extended portion 122*a* may be formed and disposed on the second main surface 112*b* of the element body 112, and the second extended portion 122*b* may be formed and disposed on the second main surface 112*b* of the element body 112.

The coil conductor 16 is formed of a conductive wire or a wire. The conductive material of the coil conductor 16 is not particularly limited, and examples of the conductive material include Ag, Au, Cu, Pd, and Ni. Preferably, Cu is used as the conductive material. Only one kind of the conductive material or two or more kinds of the conductive materials may be used.

The conductive wire used to form the coil conductor 16 is covered with an insulating substance to form an insulating coating. When the conductive wire used to form the coil conductor 16 is covered with the insulating substance, insulation between tiers of the coiled coil conductor 16 and between the coil conductor 16 and the magnetic portion 14 can be performed more reliably.

The insulating coating is not formed on each of the first exposed portion 24*a* and the second exposed portion 24*b* of the coil conductor 16. Thus, the external electrode 30 is easily formed on the exposed portions by plating. In addition, the resistance value in an electrical connection between the coil conductor 16 and the external electrode 30 can be further reduced.

The insulating substance of the insulating coating is not particularly limited, and examples of the insulating substance include a polyurethane resin, a polyester resin, an epoxy resin, and a polyamide-imide resin. Preferably, the insulating coating is made of a polyamide-imide resin.

The thickness of the insulating coating is preferably 2 μm or more and 10 μm or less (i.e., from 2 μm to 10 μm).

(D) External Electrode

The external electrodes 30 are disposed on a side of the first end surface 12*e* and a side of the second end surface 12*f* of the element body 12. The external electrodes 30 have a first external electrode 30*a* and a second external electrode 30*b*.

The first external electrode 30*a* is disposed on the surface of the first end surface 12*e* of the element body 12. The first external electrode 30*a* may be extended from the first end surface 12*e* and formed so as to cover a part of each of the first main surface 12*a*, the second main surface 12*b*, the first side surface 12*c*, and the second side surface 12*d*, or may be extended from the first end surface 12*e* to the second main surface 12*b* and formed so as to cover a part of each of the first end surface 12*e* and the second main surface 12*b*. When the first extended portion 122*a* of the coil conductor 116 is formed and exposed from the second main surface 112*b* as shown in FIGS. 6A and 6B, the first external electrode 30*a* may be formed so as to cover a part of the second main surface 112*b*. In this case, the first external electrode 30*a* is electrically connected to the first extended portion 22*a* of the coil conductor 16.

The second external electrode 30*b* is disposed on the surface of the second end surface 12*f* of the element body 12. The second external electrode 30*b* may be extended from the second end surface 12*f* and formed so as to cover a part of each of the first main surface 12*a*, the second main surface 12*b*, the first side surface 12*c*, and the second side surface 12*d*, or may be extended from the second end surface 12*f* to the second main surface 12*b* and formed so as to cover a part of each of the second end surface 12*f* and the second main surface 12*b*. When the second extended portion 122*b* of the coil conductor 116 is formed and exposed from the second main surface 112*b* as shown in FIG. 6B, the second external electrode 30*b* may be formed so as to cover a part of the second main surface 112*b*. In this case, the second external electrode 30*b* is electrically connected to the second extended portion 22*b* of the coil conductor 16.

The thickness of each of the first external electrode 30*a* and the second external electrode 30*b* is not particularly limited, but may be, for example, 1 μm or more and 50 μm or less (i.e., from 1 μm to 50 μm), preferably 5 μm or more and 20 μm or less (i.e., from 5 μm to 20 μm).

The first external electrode 30*a* includes a first base electrode layer 32*a* and a first plated layer 34*a* disposed on the surface of the first base electrode layer 32*a*. Similarly, the second external electrode 30*b* includes a second base electrode layer 32*b* and a second plated layer 34*b* disposed on the surface of the second base electrode layer 32*b*.

The first base electrode layer 32*a* is disposed on the surface of the first end surface 12*e* of the element body 12. The first base electrode layer 32*a* may be extended from the first end surface 12*e* and formed so as to cover a part of each of the first main surface 12*a*, the second main surface 12*b*, the first side surface 12*c*, and the second side surface 12*d*, or may be extended from the first end surface 12*e* and formed so as to cover a part of each of the first end surface 12*e* and the second main surface 12*b*. When the first extended portion 122*a* of the coil conductor 116 is formed and exposed from the second main surface 112*b* as shown in FIGS. 6A and 6B, the first base electrode layer 32*a* may be formed so as to cover a part of the second main surface 112*b*.

The second base electrode layer 32*b* is disposed on the surface of the second end surface 12*f* of the element body 12. The second base electrode layer 32*b* may be extended from the second end surface 12*f* and formed so as to cover a part of each of the first main surface 12*a*, the second main surface 12*b*, the first side surface 12*c*, and the second side surface 12*d*, or may be extended from the second end surface 12*f* and formed so as to cover a part of each of the second end surface 12*f* and the second main surface 12*b*. When the second extended portion 122*b* of the coil conductor 116 is formed and exposed from the second main surface 112*b* as shown in FIG. 6B, the second base electrode layer 32*b* may be formed so as to cover a part of the second main surface 112*b*.

The first base electrode layer 32*a* and the second base electrode layer 32*b* are formed of a conductive material, preferably one kind or more than one kind of metal materials selected from the group consisting of Au, Ag, Pd, Ni and Cu.

The first base electrode layer 32*a* and the second base electrode layer 32*b* are formed by application of a conductive paste, sputtering, or plating.

The first plated layer 34*a* is disposed so as to cover the first base electrode layer 32*a*. Specifically, the first plated layer 34*a* may be disposed so as to cover the first base electrode layer 32*a* disposed on the first end surface 12*e*, further extends from the first end surface 12*e* and may be disposed so as to cover the surface of the first base electrode layer 32*a* disposed on to the first main surface 12*a*, the second main surface 12*b*, the first side surface 12*c* and the second side surface 12*d*, and may be disposed so as to cover the first base electrode layer 32*a* that is extended from the first end surface 12*e* and is disposed so as to cover each of the first end surface 12*e* and the second main surface 12*b*. Further, when the first extended portion 122*a* of the coil conductor 116 is formed and directly extended to the second main surface 112*b* as shown in FIG. 6B, the first extended portion 122*a* may be formed so as to cover the first base electrode layer 32*a* that is disposed on the second main surface 112*b*.

The second plated layer 34*b* is disposed so as to cover the second base electrode layer 32*b*. Specifically, the second plated layer 34*b* may be disposed so as to cover the second base electrode layer 32*b* disposed on the second end surface 12*f*, further extends from the second end surface 12*f* and may be disposed so as to cover the surface of the second base electrode layer 32*b* disposed on the first main surface 12*a*, the second main surface 12*b*, the first side surface 12*c* and the second side surface 12*d*, and may be disposed so as to cover the second base electrode layer 32*b* that is extended from the second end surface 12*f* and disposed so as to cover a part of each of the second end surface 12*f* and the second main surface 12*b*. When the second extended portion 122*b* of the coil conductor 116 is formed and directly extended to the second main surface 112*b* as shown in FIG. 6B, the second extended portion 122*b* may be formed so as to cover the second base electrode layer 32*b* disposed on the second main surface 112*b*.

Examples of the metal material of the first plated layer 34*a* and the second plated layer 34*b* include at least one selected from Cu, Ni, Ag, Sn, Pd, an Ag—Pd alloy, and Au.

The first plated layer 34*a* and the second plated layer 34*b* may each be a plurality of layers.

The first plated layer 34*a* has a two-layer structure of a first nickel plated layer 36*a* and a first tin plated layer 38*a* formed on the surface of the first nickel plated layer 36*a*. The second plated layer 34*b* has a two-layer structure of a second nickel plated layer 36*b* and a second tin plated layer 38*b* formed on the surface of the second nickel plated layer 36*b*.

(E) Protective Layer

In the present embodiment, a protective layer 40 is provided on the surface of the element body 12 except for the first exposed portion 24*a* exposed on the first end surface 12*e* and the second exposed portion 24*b* exposed on the second end surface 12*f* in the element body 12. The protective layer 40 is made of, for example, a resin material having high electrical insulating properties, such as an acrylic resin, an epoxy resin, and a polyimide. In the present disclosure, the protective layer is not essential and does not have to be present.

In the coil component 10, when the dimension in the length direction z is defined as an L dimension, the L dimension is preferably 1.0 mm or more and 12.0 mm or less (i.e., from 1.0 mm to 12.0 mm). When the dimension in the width direction y of the coil component 10 is defined as a W dimension, the W dimension is preferably 0.5 mm or more and 12.0 mm or less (i.e., from 0.5 mm to 12.0 mm). When the dimension in the pressing direction x of the coil component 10 is defined as a T dimension, the T dimension is preferably 0.5 mm or more and 6.0 mm or less (i.e., from 0.5 mm to 6.0 mm).

2. Method for Producing Coil Component

Next, a method for producing the coil component is described. First, a method for producing a magnetic powder-containing resin material is described.

(A) Preparation of Metal Magnetic Material Grains

First, the metal magnetic material grains are prepared. Here, the metal magnetic material grains are not particularly limited, and for example, Fe-based soft magnetic material powders such as α-Fe, Fe—Si, Fe—Si—Cr, Fe—Si—Al, Fe—Ni, and Fe—Co can be used. The material form of the metal magnetic material grains is preferably an amorphous form having good soft magnetic properties, but is not particularly limited and may be a crystalline form.

As the metal magnetic material grains, two or more kinds of metal magnetic material grains having different average grain diameters can be used. The metal magnetic material grains are dispersed in a resin material. From the viewpoint of improving the filling efficiency of the metal magnetic material grains, for example, metal magnetic material grains having different average grain diameters, such as the first metal magnetic material grains having an average grain diameter of 10 μm or more and 40 μm or less (i.e., from 10 μm to 40 μm) and the second metal magnetic material grains having an average grain diameter of 5 μm or less are used.

(B) Formation of Insulating Coating

Next, a surface of the metal magnetic material grains is covered with the insulating coating. Here, when the insulating coating is formed by a mechanical method, the metal magnetic material grains and an insulating material powder are put into a rotating container to form composite grains by the mechanochemical treatment, and the insulating coating is formed on a surface of the magnetic material powder.

The insulating coating preferably has a thickness of 10 nm or more and 250 nm or less (i.e., from 10 nm to 250 nm) and an average thickness of 30 nm or more. The thickness of the insulating coating can be controlled by adjusting the treatment time during the mechanochemical treatment and the amount of the insulating material powder added. That is, the thickness of the insulating coating can be increased by increasing the amount of the insulating material powder added and prolonging the treatment time of the mechanochemical treatment.

(C) Preparation of Insulator Grains

Next, the insulator grains are prepared. The magnetism of the insulator grains is lower than the magnetism of the metal magnetic material grains. More preferably, the insulator grains are non-magnetic. The insulator grains preferably contain a glass component. The glass component contains at least one element selected from the group consisting of Si, P, Bi, B, Ba, V, Sn, Te, K, Ca, Zn, Na and Li.

Further, the insulator grains and the insulating coating that covers the metal magnetic material grains are a compound whose component is the same.

(D) Production of Magnetic Material Sheet

Next, the metal magnetic material grains covered with the insulating coating are prepared.

Subsequently, the resin material and the insulator grains are added to the metal magnetic material grains and mixed by a wet manner to produce the magnetic powder-containing resin material. The resin material is not particularly limited, and for example, an epoxy resin, a phenol resin, a polyester resin, a polyimide resin, and a polyolefin resin can be used.

As a result, the magnetic powder-containing resin material is slurried, and then the slurry is molded by a doctor blade method or the like, and then dried to produce a magnetic material sheet.

The amount of the insulator grains added in the magnetic powder-containing resin material is preferably 0.1 vol % or more and 5.0 vol % or less (i.e., from 0.1 vol % to 5.0 vol %), more preferably 0.1 vol % or more and 4.0 vol % or less (i.e., from 0.1 vol % to 4.0 vol %), and further preferably 1.0 vol % or more and 2.0 vol % or less (i.e., from 1.0 vol % to 2.0 vol %). As for the content of the insulator grains, the rate of the amount of the insulator grains added to the amount of the metal magnetic material grains added is preferably 0.1 vol % or more and 6.0 vol % or less (i.e., from 0.1 vol % to 6.0 vol %), more preferably 0.1 vol % or more and 4.8 vol % or less (i.e., from 0.1 vol % to 4.8 vol %), and further preferably 1.2 vol % or more and 2.4 vol % or less (i.e., from 1.2 vol % to 2.4 vol %).

(E) Production of Collective Substrate

Next, copper is used as a wire conductor, and coil conductors 16 in an α-winding shape and formed of a flat type conductor wire covered with the insulating coating are prepared.

Subsequently, an element body 12 in which the coil conductors 16 are embedded is produced.

First, a first mold is prepared, and the coil conductors 16 are arranged on the first mold in a matrix shape.

Next, a first magnetic material sheet formed of a mixture containing the first metal magnetic material grains, the second metal magnetic material grains, the resin material, and the insulator grains is placed on these coil conductors 16. Next, the first magnetic material sheet is sandwiched between the first mold and a second mold and subjected to primary mold pressing. At least a part of the coil conductors 16 are embedded in the sheet by this primary mold pressing, and the mixture is filled inside the coil conductors 16 to produce a first molded body.

Next, the first molded body in which the coil conductors 16 are embedded and obtained by the primary mold pressing is released from the first mold, and then, a different second magnetic material sheet is placed on the exposed surface of the coil conductors 16. Then, the second magnetic material sheet is sandwiched between the primary molded body on the second mold and a third mold, and secondary mold pressing is performed.

As described above, a collective substrate (second molded body) in which the entire coil conductors 16 are embedded in the first magnetic material sheet and the second magnetic material sheet is produced by the secondary mold pressing.

(F) Production of Element Body

Next, the second mold and the third mold are released to obtain the collective substrate. Then, the collective substrate is cut into individual pieces using a cutting tool such as a dicer. By this individualization, element bodies 12 in each of which the coil conductors 16 are embedded are produced so that the first exposed portion 24*a* and the second exposed portion 24*b* of the coil conductors 16 are exposed from both end surfaces of the element bodies 12. The collective substrate can be divided into the element bodies 12 using a dicing blade, various laser devices, a dicer, various blades, or a mold. In a preferred aspect, the cut cross section of the element bodies 12 is subjected to barrel polishing.

Next, the protective layer 40 is formed on the entire surface of the element bodies 12 obtained above. The protective layer 40 can be formed by electrodeposition coating, a spray method, a dip method, or the like.

A part around the part of the coil conductors 16 of the element bodies 12 covered with the protective layer 40 obtained above, at which the first exposed portion 24*a* and the second exposed portion 24*b* are arranged, is irradiated with a laser. By this irradiation, the protective layer around the part of the coil conductors 16, at which the first exposed portion 24*a* and the second exposed portion 24*b* are arranged, the metal magnetic material grains, and the insulating coating covering the metal magnetic material grains are removed, and in addition, the metal magnetic material grains are melted.

(G) Formation of External Electrode

Next, the first external electrode 30*a* is formed on the first end surface 12*e* of the element body 12, and the second external electrode 30*b* is formed on the second end surface 12*f*.

First, the element body 12 is subjected to copper plating by electrolytic barrel plating to form a base electrode layer. Subsequently, a nickel plated layer is formed by nickel plating on the surface of the base electrode layer, and a tin plated layer is further formed by tin plating to form the external electrode 30. As a result, the first exposed portion 24*a* of the coil conductor 16 is electrically connected to the first external electrode 30*a*, and the second exposed portion 24*b* of the coil conductor 16 is electrically connected to the second external electrode 30*b*.

The coil component 10 is produced as described above.

In the mechanochemical treatment in a step of forming the insulating coating on the metal magnetic material grains, when the material of the insulating coating is excessively added, not all the material may turn into the insulating coating and a part of the material remain as a residue. The residue mixed in the magnetic portion 14 can also act as the insulator grains. Therefore, there is no need to remove the material of the insulating coating that remains as the residue according to the present embodiment.

In the mechanochemical treatment in the step of forming the insulating coating on the surface of the metal magnetic material grains, it is also possible to adjust the amount of the insulating material powder added to adjust the thickness of the insulating coating of the metal magnetic material grains and the content of the insulator grains in the magnetic portion 14. The content of the insulator grains in the magnetic portion 14 can also be adjusted by removing the residue of the insulating material powder.

As a method of removing the residue of the insulating material powder, classification by wind, washing, a mesh treatment, or the like can be performed.

In the coil component 10 shown in FIG. 1, since the magnetic portion 14 contains the insulator grains having magnetism lower than the magnetism of the metal magnetic material grains, the DC superposition characteristic is improved.

Further, in the coil component 10 shown in FIG. 1, insulator grains having magnetism lower than the magnetism of the metal magnetic material grains are dispersed and disposed in the entire magnetic portion 14. Therefore, the insulator grains dispersed in the magnetic portion 14 and the insulating coating of the metal magnetic material grains can cut the flow of the magnetic flux to improve the DC superposition characteristic, and the decrease of the inductance value can be suppressed because the flow of the magnetic flux is not completely cut.

Also, in the coil component 10 shown in FIG. 1, when the thickness of the insulating coating that covers the metal magnetic material grains is set to, for example, 30 nm or more, the distance between the metal magnetic material grains can be increased, so that the DC superposition characteristic can be improved and the decrease of the inductance value can be suppressed similarly to the above.

Therefore, the magnetic portion 14 contains the insulator grains having magnetism lower than the magnetism of the metal magnetic material grains, and the thickness of the insulating coating covering the metal magnetic material grains is increased, and thus the coil component 10 that can improve the DC superposition characteristic can be obtained.

When the amount of the insulator grains added in the magnetic powder-containing resin material is 0.1 vol % or more and 4.0 vol % or less (i.e., from 0.1 vol % to 4.0 vol %), the decrease of the L value due to a moisture resistance shelf test of the coil component can be suppressed. Furthermore, when the rate of the amount of the insulator grains added to the amount of the metal magnetic material grains added is 0.1 vol % to 4.8 vol % or less (i.e., from 0.1 vol % to 4.8 vol %), the decrease of the L value due to the moisture resistance shelf test can be suppressed. Thus, reliability of the coil component 10 can be improved.

3. Experimental Examples

Next, in order to confirm the effects of the coil component formed from the magnetic powder-containing resin material according to the present disclosure described above, experiments were conducted to evaluate the effective magnetic permeability, the saturation magnetic flux density, and the decrease rate of the L value after the moisture resistance shelf test.

(1) Specifications of Sample

The specifications of a sample used in the experiments are as follows.

The dimensions (design values) of the coil component were an L dimension of 1.6 mm, a W dimension of 0.8 mm, and a T dimension of 0.8 mm.

Material of Magnetic Portion

First metal magnetic material grains: Fe-based alloy (Fe—Si—Cr-based), average grain diameter: 35 μm Second metal magnetic material grains: Fe-based alloy (Fe—Si—Cr-based), average grain diameter: 5 μm Material of insulating coating: phosphate glass Insulator grains: phosphate glass Resin: epoxy resin Material of coil conductor: copper Material of protective layer: acrylic resin, thickness: 4 μm Structure of External Electrode Three-layer structure by copper plating, nickel plating and tin plating Table 1 shows the amount of the insulator grains added to each sample.

(2) Calculation of Effective Magnetic Permeability

The effective magnetic permeability of the coil component of each sample was calculated as follows.

The inductance of the coil component was measured with an impedance analyzer, and the inductance at 1 MHz was measured. For example, using a coil conductor known to have an inductance L=0.26 μH and DC saturation current Isat=5.0 A when a coil component is produced from a material having an effective magnetic permeability of 20 and a saturation magnetic flux density Bs=0.90, a coil component was prototyped. Since the inductance changes linearly with the effective magnetic permeability, the inductance was converted into the effective magnetic permeability.

(3) Measurement of Saturation Magnetic Flux Density

The saturation magnetic flux density in the coil component of each sample was measured as follows.

The change of the inductance when a DC current was applied to the coil component was measured, and the current value when the inductance was decreased by 30% from the initial inductance was defined as the DC saturation current. For example, using a coil conductor known to have an inductance L=0.26 μH and DC saturation current Isat=5.0 A when a coil component is produced from a material having an effective magnetic permeability of 20 and a saturation magnetic flux density Bs=0.90, a coil component was prototyped. Since the saturation magnetic flux density correlates with the DC saturation current, the DC saturation current was converted into the saturation magnetic flux density.

(4) Method of Measuring Moisture Resistance Shelf Test

The moisture resistance shelf test was conducted on the coil component of each sample as follows. That is, under the conditions of 85° C. and 85% relative humidity (RH), the L value was measured at the initial stage and after 1000 hours in the test, and the decrease rate of the L value was calculated.

(5) Method of Measuring Thickness of Insulating Coating

The thickness of the insulating coating of the metal magnetic material grains was observed and measured with a transmission electron microscope (TEM) after a focused ion beam (FIB) treatment. Specifically, 5 grains were selected, 3 sites per grain, that is, 15 sites in total were observed, and the average of the thicknesses was calculated to obtain the average thickness. The observation magnification was 50000 times or more and 500000 times or less (i.e., from 50000 times to 500000 times).

Table 1 shows the evaluation results for each of "Effective magnetic permeability", "Saturation magnetic flux density", "Decrease rate of L value after moisture resistance shelf test", and "Average thickness of insulating coating" in each of the examples and the comparative example.

TABLE 1

| | Amount of insulator grains added (to volume of magnetic portion) (vol %) | Amount of insulator grains added (to metal magnetic material grains) (vol %) | Effective magnetic permeability | Saturation magnetic flux density: Bs (T) | Decreasing rate of L value after moisture resistance shelf test (%) | Average thickness of insulating coating (nm) |
|---|---|---|---|---|---|---|
| Example 1 | 1.0 | 1.2 | 19.7 | 0.91 | −2.5 | 30 |
| Example 2 | 2.0 | 2.4 | 19.5 | 0.92 | −2.5 | 30 |

TABLE 1-continued

| | Amount of insulator grains added (to volume of magnetic portion) (vol %) | Amount of insulator grains added (to metal magnetic material grains) (vol %) | Effective magnetic permeability | Saturation magnetic flux density: Bs (T) | Decreasing rate of L value after moisture resistance shelf test (%) | Average thickness of insulating coating (nm) |
|---|---|---|---|---|---|---|
| Example 3 | 3.0 | 3.6 | 19.3 | 0.93 | −5.0 | 30 |
| Example 4 | 4.0 | 4.8 | 19.1 | 0.94 | −8.0 | 30 |
| Example 5 | 5.0 | 6.0 | 18.7 | 0.95 | −9.5 | 30 |
| Example 6 | 5.0 | 6.0 | 20.1 | 0.88 | −8.8 | 10 |
| Comparative Example | 0.0 | 0.0 | 19.9 | 0.89 | −2.0 | 30 |

(6) Evaluation Results

First, according to Table 1, it was found that the effective magnetic permeability is slightly decreased as the amount of the insulator grains added in the magnetic powder-containing resin material is increased. According to Table 1, it was also found that the saturation magnetic flux density increases as the amount of the insulator grains added in the magnetic powder-containing resin material is increased. Further, according to Table 1, it was confirmed that the L value is greatly decreased when the rate of the amount of the insulator grains added to the amount of the magnetic powder-containing resin material exceeds 2.0 vol %.

When the coil components of the samples of Examples 1 to 5 and the coil component of the sample of comparative example were compared, the coil components of the samples of Examples 1 to 5 contained insulator grains, and it was found that the increase rate of the saturation magnetic flux density was higher than the decrease rate of the effective magnetic permeability in the coil components of the samples of Examples 1 to 5.

Moreover, when the coil components of the samples of Examples 5 and 6 were compared, since the insulating coating of the coil component of the sample of Example 5 had an average thickness of 30 nm, it was found that a coil component having a relatively high saturation magnetic flux density can be obtained.

Furthermore, in Examples 1 to 4, when the amount of the insulator grains added in the amount of the magnetic portion is 1.0 vol % or more and 4.0 vol % or less (i.e., from 1.0 vol % to 4.0 vol %), the decrease rate of the L value after the moisture resistance shelf test can be suppressed to −8.0%. It was clarified that when the amount of the insulator grains added to the amount of the metal magnetic material grains is 1.2 vol % or more and 4.8 vol % or less (i.e., from 1.2 vol % to 4.8 vol %), the decrease rate of the L value after the moisture resistance shelf test can be suppressed to −8.0%.

Furthermore, in Examples 1 and 2, when the amount of the insulator grains added in the amount of the magnetic portion is 1.0 vol % or more and 2.0 vol % or less (i.e., from 1.0 vol % to 2.0 vol %), the decrease rate of the L value after the moisture resistance shelf test can be suppressed to −2.5%. It was clarified that when the amount of the insulator grains added to the amount of the metal magnetic material grains is 1.2 vol % or more and 2.4 vol % or less (i.e., from 1.2 vol % to 2.4 vol %), the decrease rate of the L value after the moisture resistance shelf test can be suppressed to −2.5%.

In the coil components of samples of Examples 5 and 6 containing a relatively large amount of zinc phosphate glass having low moisture resistance as insulator grains, the decrease rate of the L value after the moisture resistance shelf test is large. It is considered that the result was obtained for the following reasons. That is, it is considered that the zinc phosphate glass as the insulator grains was dissolved in an environment as in a moisture resistance shelf test, and the metal magnetic material grains were rusted due to moisture entering through a gap formed after the dissolution, and as a result, the inductance (L value) was decreased.

As described above, the embodiments of the present disclosure are disclosed in the above description, but the present disclosure is not limited to these.

That is, various modifications can be made to the embodiments described above with respect to the mechanism, shape, material, quantity, position, arrangement, or the like without deviation from the technical idea and the objects of the present disclosure, and those modifications are included in the present disclosure.

What is claimed is:

1. A coil component comprising:

an element body including a coil conductor and a magnetic portion, the coil conductor including a wound conductor wire, and the magnetic portion containing metal magnetic material grains covered with an insulating coating, a resin, and insulator grains, the insulating coating having a uniform composition and being in contact with an entire outer surface of the metal magnetic material grains; and an external electrode electrically connected to an extended portion of the coil conductor and disposed on a surface of the element body, the insulator grains having a relative permeability lower than a relative permeability of the metal magnetic material grains, the insulator grains and the insulating coating being a compound whose main component is the same, and the magnetic portion includes an insulating material configured such that a portion of the insulating material is the insulating coating on the metal magnetic material grains and a remaining portion of the insulating material is the insulator grains distributed in the magnetic portion.

2. The coil component according to claim 1, wherein the insulator grains are non-magnetic.

3. The coil component according to claim 1, wherein the insulating coating has a thickness of from 10 nm to 250 nm, and an average thickness of 30 nm or more.

4. The coil component according to claim 1, wherein a rate of a volume of the insulator grains in a volume of the magnetic portion is from 1.0 vol % to 4.0 vol %.

5. The coil component according to claim 1, wherein
a rate of a volume of the insulator grains added to a volume of the metal magnetic material grains is from 1.2 vol % to 4.8 vol %.

6. The coil component according to claim 1, wherein
the insulating coating and the insulator grains contain glass.

7. The coil component according to claim 2, wherein
the insulating coating has a thickness of from 10 nm to 250 nm, and an average thickness of 30 nm or more.

8. The coil component according to claim 2, wherein
a rate of a volume of the insulator grains in a volume of the magnetic portion is from 1.0 vol % to 4.0 vol %.

9. The coil component according to claim 3, wherein
a rate of a volume of the insulator grains in a volume of the magnetic portion is from 1.0 vol % to 4.0 vol %.

10. The coil component according to claim 2, wherein
a rate of a volume of the insulator grains added to a volume of the metal magnetic material grains is from 1.2 vol % to 4.8 vol %.

11. The coil component according to claim 2, wherein
the insulating coating and the insulator grains contain glass.

12. A method for producing a magnetic powder-containing resin material, the method comprising:
mixing metal magnetic material grains and an insulating material, a relative permeability of the insulating material being lower than a relative permeability of the metal magnetic material grains;
forming an insulating coating on a surface of the metal magnetic material grains using a part of the insulating material by a mechanochemical treatment, the insulating coating having a uniform composition and being in contact with an entire outer surface of the metal magnetic material grains; and
mixing the metal magnetic material grains covered with the insulating coating, a remaining part of the insulating material, and a resin material, to form a magnetic portion which includes the insulating material configured such that a portion of the insulating material is the insulating coating on the metal magnetic material grains and a remaining portion of the insulating material is the insulator grains distributed in the magnetic portion.

13. The method according to claim 12, wherein
the insulating material is non-magnetic.

14. The method according to claim 12, wherein
a content of the remaining part of the insulating material in the magnetic powder-containing resin material is from 1.0 vol % to 4.0 vol %.

15. The method according to claim 12, wherein
a ratio of a content of the remaining part of the insulating material to a content of the metal magnetic material grains in the magnetic powder-containing resin material is from 1.2 vol % to 4.8 vol %.

16. The method according to claim 12, wherein
the insulating material contains glass.

17. The method according to claim 13, wherein
a content of the remaining part of the insulating material in the magnetic powder-containing resin material is from 1.0 vol % to 4.0 vol %.

18. The method according to claim 13, wherein
a ratio of a content of the remaining part of the insulating material to a content of the metal magnetic material grains in the magnetic powder-containing resin material is from 1.2 vol % to 4.8 vol %.

19. The method according to claim 14, wherein
a ratio of a content of the remaining part of the insulating material to a content of the metal magnetic material grains in the magnetic powder-containing resin material is from 1.2 vol % to 4.8 vol %.

20. The method according to claim 13, wherein
the insulating material contains glass.

* * * * *